United States Patent [19]

So

[11] Patent Number: 4,903,840

[45] Date of Patent: Feb. 27, 1990

[54] SELF ADHESIVE NAIL COATINGS

[75] Inventor: Dae S. So, Seoul, Rep. of Korea

[73] Assignee: Hwo Young Park, Cliffside Park, N.J.

[21] Appl. No.: 200,015

[22] Filed: May 27, 1988

[30] Foreign Application Priority Data

May 29, 1987 [KR] Rep. of Korea ..... 5390

[51] Int. Cl.[4] ..... A45D 29/00

[52] U.S. Cl. ..... 206/581; 428/40; 428/76; 428/511; 428/15; 428/335; 206/460; 206/526; 206/823; 132/73

[58] Field of Search ..... 428/40, 76, 335, 15, 428/511; 132/73; 424/61; 206/823, 219, 581, 526, 460, 484

[56] References Cited

U.S. PATENT DOCUMENTS

| | | | |
|---|---|---|---|
| 2,581,982 | 3/1950 | Terry | 132/73 |
| 2,688,331 | 9/1954 | Bogoslowsky | 132/73 |
| 2,764,168 | 9/1956 | Herz | 424/61 |
| 2,816,555 | 12/1957 | Klump | 132/73 |
| 4,126,144 | 11/1978 | Duarte | 132/73 |
| 4,158,053 | 6/1979 | Greene et al. | 424/61 |
| 4,283,324 | 8/1981 | Duffy | 428/15 |

FOREIGN PATENT DOCUMENTS

| | | | |
|---|---|---|---|
| 1186543 | 11/1957 | France | 132/73 |
| 559019 | 12/1972 | Switzerland | 132/73 |
| 88/02227 | 4/1988 | World Int. Prop. O. | 132/73 |

*Primary Examiner*—Ellis P. Robinson
*Assistant Examiner*—Archene A. Turner
*Attorney, Agent, or Firm*—Peter L. Berger

[57] ABSTRACT

A method of manufacturing adhesively-securable, fingernail coatings and an adhesively-securable fingernail covering product, too. The nail polish-like material is provided in semi-solid form on a sheet of adhesive-backed peel-off paper, which, when removed, exposes the adhesive of the fingernail coatings. The fingernail coatings are, after removal from a substantially air-tight package, cut into individual sections, located on the fingernails and pressed onto the fingernails to secure them there, temporarily, i.e., until they are desirably removed. The edges can then be cut to the length and width, as well as the curvature of the nail on which they are placed. The semi-solid nail enamel product is originally sealed in an air tight envelope to ensure that the coatings do not fully dry out during shipping and storage. Upon removal of the fingernail coatings and securing them on the individual's fingernails, as just described, the semi-solid polish will completely dry and "cure" and, in addition, a slight aroma of liquid nail polish enamel is emitted. The fingernail coatings are manufactured by pouring liquid enamel onto an adhesive backed sheet of paper and, after a period of drying at a predetermined temperature, are packaged, in semi-solid form. The coatings can also be provided with designs, pictures or stripes.

7 Claims, 3 Drawing Sheets

FIG. 4A
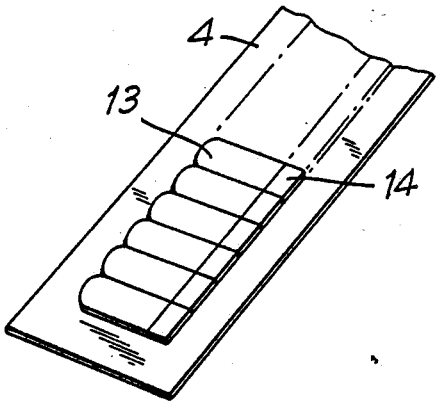
FIG. 4B
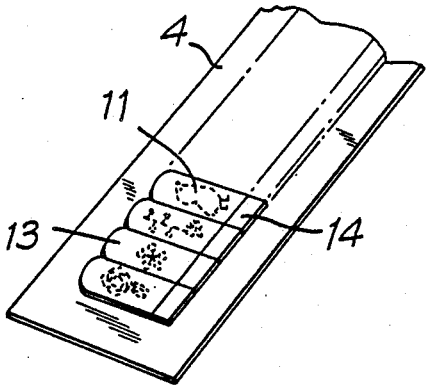
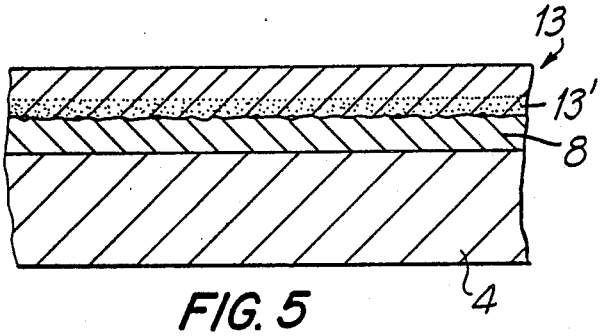
FIG. 5
FIG. 6
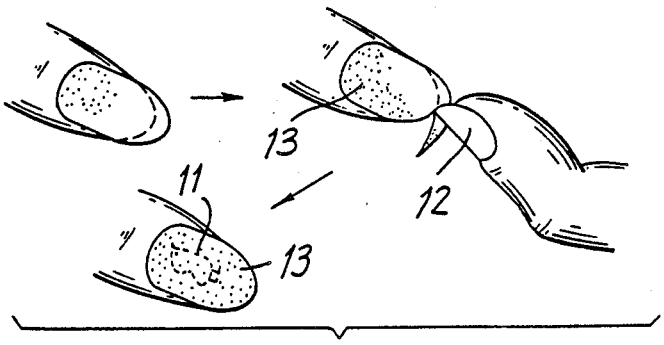

SELF ADHESIVE NAIL COATINGS

BACKGROUND OF THE INVENTION AND DESCRIPTION OF THE PRIOR ART

The present invention relates to fingernail coatings or press-on nails which are intended to provide an attractive, finished-looking, fingernail polished-looking coating. It is quite common today for women's fingernails to be coated with liquid enamel, which is dried by exposure to the air. The drying time requires, of course, that the nails not come into contact with any object, lest the nail coating become smudged or smeared. In addition, it is currently quite fashionable for French manicuring or polishing, i.e., applying a first coat of liquid nail polish to the nails, allowng them to dry and then superimposing thereon a partial second coat of liquid enamel to create a fanciful design. For example, the first coat is ordinarily a solid background of a first color, while the second coating, after the first is dried, is applied only to the tip of the nail, in a second color, or a set of diagonal stripes, across the dried first layer of nail polish is provided. The present invention relates to providing, in a simple and efficient, relatively inexpensively, manner, a product which allows fingernails to be quickly coated with a high-gloss, enamel-look. The product can be of a single color for ordinary looking fingernail polishing or, preferably, a fanciful design superimposed on a solid color background of nail polish enamel can be provided for a French manicure look. The manicure or freshly polished look, provided by the present invention, is accomplished by directly adhering, by self-adhesive means, a fingernail coating to the nails, consisting of semi-solid nail enamel. This, then, eliminates application of liquid enamel to the fingernails by manually brushing. Also, the prior art method of applying a coat of liquid nail polish to the fingernails suffers from the disadvantage that uniformity of thickness of application is extremely difficult, often resulting in a portion or all of one nail being coated with more nail polish than another portion or all of another nail. This lack of uniformity often caused the wearer to remove the polish, after drying, and then reapply a new coat of liquid polish in an attempt to provide uniformity of nail polish application.

Another problem which the prior art application of liquid nail polish suffered from, was that the wearer's skin often negatively reacted to the accidental contact with the nail polish, which was quite often due to the manual brushing of the polish, in liquid form, onto the skin. The use of the same nail enamel, but, now, however, in a semi-solid form, eliminates the accidental contact between the liquid nail enamel and the user's skin and the negative reaction therebetween is eliminated.

The method of manufacturing the present invention contemplates pouring the liquid enamel into a mold. A backing sheet of adhesively-peelable paper is slowly drawn through a passage of the mold to thereby coat the paper with a uniform thickness of nail polish. After drying, semi-solid, enamel-looking fingernail coatings result. If desired, pad printing of fanciful designs can be done on top of the partially dried coatings. The fingernail coatings are sealed and packaged in an air tight envelope so that when it is desired to use the product, the package is opened and after application of the coatings to the nails, the coatings are finally volatilized, i.e., "cured". The fingernail coatings are manufactured in groups of five nails to a strip and the user merely cuts the individual fingernail segments from the strip to facilitate coating each of the fingernails of a hand. A peel strip is also provided to facilitate the removal of the coatings from the adhesive backed paper.

The prior art, with respect to the product disclosed herein, is, of course, liquid finger nail enamel which comes in bottled form and is applied by either a manicurist or the individual, herself, by brushing onto the fingernails and then drying. As previously mentioned, fingernails, after being brushed with the liquid enamel, must dry, without touching anything else, for a few minutes. During this time, however, the just-coated fingernails emit, by virtue of the fragrance of the curing enamel, a pleasant but, often, too overpowering aroma. The French manicure or polishing of women's nails, recently quite popular, requires a second, partial, coating of the completely dried fingernails. This, of course, is time consuming and, in addition, requires the applier, whether manicurist or the individual, herself, to be quite adept at brushing only a portion of each nail with a design of a second color of enamel. Clearly, this is quite difficult, labor intensive, frequently unsuccessful, due to smearing, hand moving, shaking, etc. and rather expensive.

The present invention relates to a method of manufacturing finger nail coatings in a semi-solid state. A set of fingernail coatings are provided for simple and inexpensive application to the nails which will not smudge or smear, need minimal time to dry and, wet, can be preprinted with a design to look like the "perfect" manicure and French manicure. In addition, the curing of the semi-solid fingernail coatings emits an aroma almost identical in smell, but on a reduced level (due to reduced volatility of the semi-solid nail enamel of the coatings) to that of the drying of ordnary liquid enamel and that, too, enhances the desireability, while retaining authenticity, of the semi-solid fingernail coating application process.

SUMMARY OF THE INVENTION

The present invention relates to a method of manufacturing a set of fingernail coatings or a manicure film in semi-solid form which, until desirably used, is stored in an air-tight envelope and to a product so formed. The invention also relates to the product, itself, independent of the method of manufacture. Upon application, the user removes the film from the package, separates the strip of film into individual nail coatings, removes the adhesive backing sheet from the film and places the film on an individual nail. The end or edge of the nail coatings are then trimmed to correspond precisely to the nail shape and dimensions. Then, the nail film, now in individual nail shapes, is adhesively secured to the nails, by pressing them firmly onto the nails. The nails are then further air dried or "cured" in a very short time period. During the drying time, however, the nail coatings will emit a pleasing aroma, quite similar to that generated by liquid nail enamel when it is drying but on a much reduced aromatic level.

The nail coatings are made by using a mold having a pour hole and a slot or passage for a sheet of adhesively-backed paper to pass through. Liquid nail enamel is poured onto the sheet of adhesively-backed paper as it is lowly drawn through the mold. A uniformly coated, adhesively backed nail coating sheet is thus provided. The sheet is then dried, for a predetermined time, at a predetermined temperature or, until, the sheet has the nail enamel coating in a semi-solid, yet not completely dried state. The strip is then preferably cut into sets of five fingernail coatings. Preferably, too, the sheet is provided with a ribbon or tear strip which serves to facilitate the individual application of the nail coatings to the fingernails by easing removal of the coatings from the adhesive-backed paper. The sets of coatings, after partial drying, are encased in a substantially air-tight envelope until used.

BRIEF DESCRIPTION OF THE DRAWINGS

Drawing 1 is an exploded view of the mold appatatus for manufacturing the nail coatings.

Drawing 2 is a longitudinal cross-sectional view of the mold for manufacturing the nail coatings, shown in its assembled state.

Figure 1:
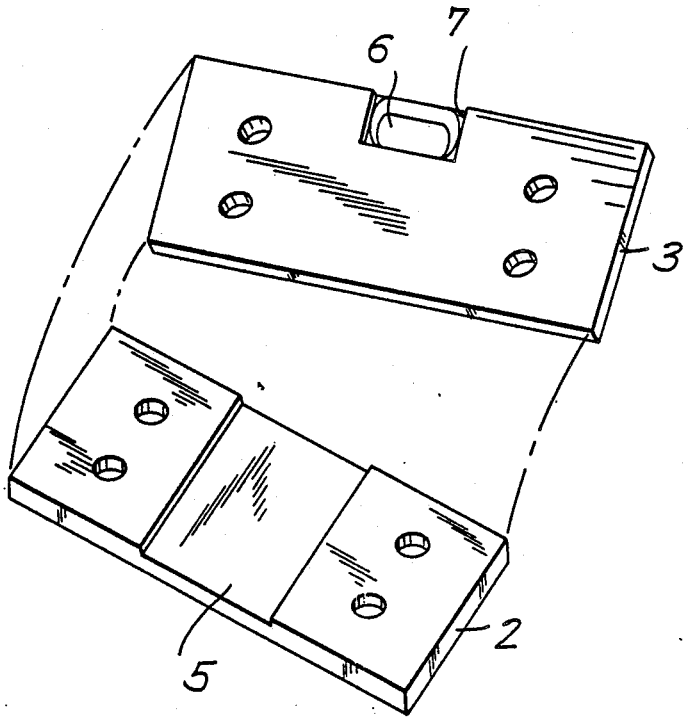
Figure 2:
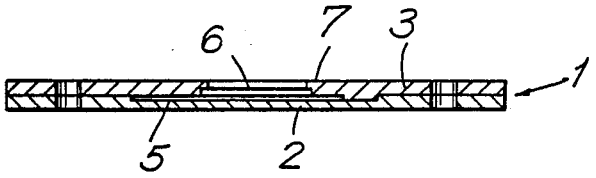
Figure 3A:
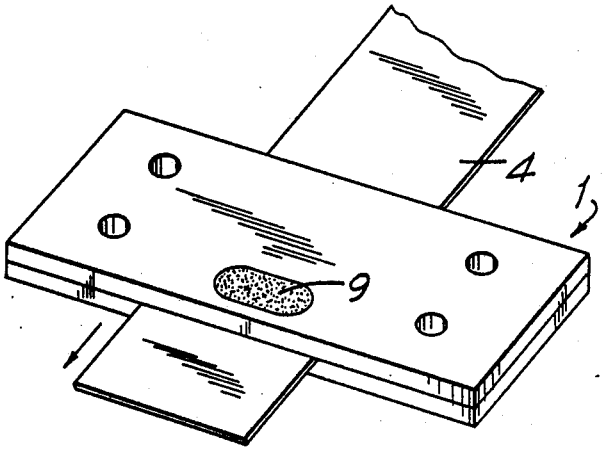
Figure 3B:
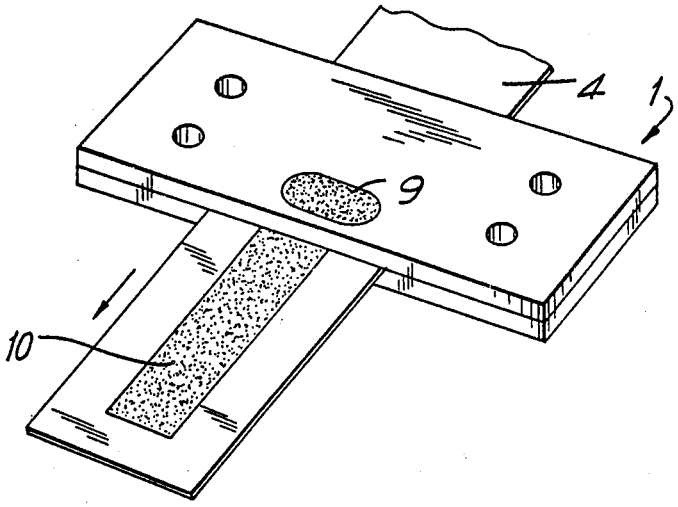

Drawing 3(A) is a perspective view of the mold apparatus for manufacturing the nail coatings, shown with the adhesive-backed strip of paper located in the mold yet, prior to passing the paper through the mold. The drawing also shows the mold fill-hole full of liquid nail enamel.

Drawing 3(B) is a perspective view of the mold apparatus for manufacturing the nail coatings, shown with the adhesive-backed strip of paper having been partially pulled through the mold, and the liquid nail enamel having been uniformly coated onto a portion of the strip of paper; the level of liquid nail enamel, in the mold fill-hole being lower than that shown in Drawing 3(A), since a portion of the liquid has now been transferred to the strip of paper, as also shown in this drawing.

Drawing 4(A) is a partial perspective view of the nail coating product or manicure film, after it has been appropriately cut and shows individual nail coatings.

Drawing 4(B) is a partial perspective view of the nail coating product or manicure film after it has been further coated or printed with an attractive design, superimposed on top of the initial colored background, of semi-solid, nail enamel.

Drawing 5 is a partial cross-sectional view of the nail coatings, after drying on the adhesively-backed paper, i.e., the manicure film is coated on the adhesive-backed paper and some adhesive is transferred to the nail enamel on its bottom or underneath surface.

Drawings 6 show the fingernail coatings, after application to an individual nail, and also shows a second finger and nail of the fingernail coating-applying individual, as it is used for further trimming of the fingernail coating to the shape and dimensions of the nail on which the coating is applied. The Drawings also show the finished "polished" look of the individual's fingernails, both with a solid color nail enamel and, in addition, shows the fingernail coating if it has the printed design superimposed on a solid color background.

DETAILED DESCRIPTION OF THE DRAWINGS AND THE PREFERRED EMBODIMENT OF THE INVENTION

The present invention, as mentioned, relates to fingernail coatings which are applied to an individual's nails in a minimum of time, with minimum effort, require a minimum of drying time and, yet, provide a visually pleasing look of "just polished", high gloss, appear as if the nails were polished with liquid nail polish and, also, provide, where desired, the look of a French manicure, i.e., the look of a design of nail polish coated on top of a background of solid nail polish. In addition, the present invention provides, during the final curing or drying of the semi-solid nail coatings, the otherwise available and olfactory pleasing smell of liquid nail enamel as it dries but on a reduced level.

According to the method of manufacturing the present nail coatings, a mold (best seen in Drawings 1, 2, 3 and 4) is used, generally referred to as 1, and comprises a bottom half or panel 2 and an upper half or panel 3. The bottom half or panel 2 has a center passage 5 recessed therein which serves to guide the passage of and hold a strip of adhesively-backed paper therethrough, when the mold is assembled together. The depth of the passage 5 is sufficient to allow the adhesive-backed strip of paper 4 to be easily pulled through the mold and to have the liquid nail polish become uniformly coated onto the strip of paper as it is pulled through the mold at a uniform rate. A set of alignment and mold securing holes are provided along with corresponding pegs to assemble the halves 2 and 3 together.

The upper half or panel 3 is provided with a mold fill hole or aperture 6 which completely passes through the upper half or panel 3. When the mold halves 2 and 3 are assembled together, as seen in Drawings 2, 3 and 4, liquid nail enamel can be poured into the mold fill hole 6 and as the paper strip 4, having an adhesive backing, is pulled through the passage 5 (with the adhesive material facing towards the bottom of the upper half or panel 3), the liquid nail enamel is uniformly coated onto the strip of paper. It should be appreciated that the strip of paper provides adhesiveness beneath the application of the liquid nail enamel so that upon separation of the adhesive backing sheet from the nail coatings, after initial drying of the liquid nail coatings into their semi-solid state, the nail coatings are themselves adhesively backed and thus capable of being easily secured, by location and pressing, onto the nail.

In the preferred embodiment of the present invention, the mold fill hole 6 downwardly expands, from the top of the upper half or panel 3 to the bottom thereof, i.e., it outwardly tapers from the top surface of the upper half or panel 3 to the bottom surface (the surface which is intended to be placed immediately over and in contact with the upper surface of the bottom half or panel 2). This allows the nail enamel liquid to spread out over a larger area than area of the top opening of the mold fill hole 6. Preferably, the length of the bottom or enlarged portion 7 of the mold fill hole 6 corresponds to the length of the fingernails sought to be coated with the ultimate product produced by the mold, i.e., the fingernail coatings.

Drawing 3(A) shows a strip of adhesive-backed paper 4, located between the upper half or panel 3 and the lower half or panel 2 of the mold 1, with the paper 4 secured within the confines of passage 5. This drawing also shows the mold, in its assembled state, with the mold fill hole 6 fully filled with liquid nail enamel 9. Thus, the mold 1 is ready to manufacture the semi-solid nail coatings, the ultimate product to be produced by the present invention. The arrow shown in Drawing 3(A) shows the intended direction of pulling the paper 4, during the manufacturing process.

Drawing 3(B) shows the same assembled mold, after a portion of the adhesively-backed strip of paper 4 has been pulled through the passage 5 of the mold 1. This Drawing shows the paper 4 coated with a uniform thickness of nail enamel 10 of substantially the same length as the length of the larger portion 7 of the fill up hole 6 (See Drawing 3(B)). Further, ths Drawing shows how the level of the liquid nail enamel 9 has become reduced down below the top surface of the upper half or panel 3, as the paper 4 has been pulled through the mold and as the nail enamel has become coated onto the paper 4. Clearly, the downward decrease of the level of the liquid nail enamel 9 is directly related to the quantity of liquid nail enamel coated onto the adhesively-backed sheet of paper 4.

According to the invention, the upper half or panel 3 overlies the lower half or panel 2. After inserting the adhesive-backed paper 4 between the panels 2 and 3, within the confines of passage 5, the liquid nail enamel 9 is injected into the mold fill hole 6. Then, the paper is slowly and at a uniform rate, pulled through the passage 5. The lamination of the paper 4 with the liquid nail enamel 9 is preferably to a thickness of about 0.04 mm (40 microns). Subsequently, the paper, with the liquid nail enamel coated thereon, is dried at about 30° C. for about 5 minutes. It is then further cooled for about 2 to 3 minutes at about 0° C. This produces a semi-solid set of nail coatings which are adhesively-backed, when removed from the paper 4.

During the lamination or coating of the nail enamel onto the strip of paper, much of the solvent of the nail enamel volatilizes. The film, as mentioned, turns into a semi-solid state as it is dried at about 30° C. for about 5 minutes. The adhesive layer of the adhesive-backed strip of paper 4 maintains its adhesion and yet, transfers it to the underside of the coatings because the nail enamel does not significantly volatilize there. The film 10 does not fully dry since it is cooled, after initial drying, at about 0° C. for about 2 to 3 minutes.

Drawing 5 shows a partial cross-sectional view of the nail coatings after drying on the adhesively backed paper. The film (13) is coated on the adhesively-backed paper (4) and some of the adhesive (8) is transferred to the nail enamel (13') on its bottom or underneath surface.

If desired, fanicful drawing patterns are pad printed onto the cooled and dried semi-solid nail coatings. The drawing patterns 11 are shown in Drawing 4(B) and also in Drawing 6. Then, after pad printing with the drawing patterns, if desired, the enamel portion of the strips are scored and trimmed according to the size of the fingernails 12. The coatings are cut into sets of five fingernail coatings and stored or packaged in a semi-solid state in a closed container. Preferably, the container is an air-tight plastic envelope.

The fingernail coatings, after drying can be handled rather cleanly and the coatings can be easily attached to fingernails. Preferably, the attachment of the fingernail coatings to the fingernails is facilitated by the use of a ribbon or tear strip 14, attached at one side of the semi-solid nail enamel coatings.

The semi-solid fingernail coatings, when desirably attached to the fingernails, are removed from the packaging, as a set of five fingernails, i.e., enough for coating an entire hand, separated, if desired into individual nail coatings, removed from the adhesive-backed strip of paper (facilitated by the ribbon or tear strip 14) and initially secured to the nail. Then, the fingernail coatings are firmly pressed onto the nail. After securing it to the nail, the portion of the nail coating extending over the edge of the nail can be cut off, by scissor, or by using another nail and scraping it against the edge of the just-coated nail. It is then a short period of time for the fingernail coatings to completely dry.

It should be appreciated that the scope of the present invention is not limited to the drawings illustrated or the embodiments described herein. Rather, it should be understood that the specific forms of the invention herein illustrated and described are intended to be representative only, as certain changes may be made therein, without departing from the clear teachings of the disclosure. Accordingly, reference should be made to the following appended claims, as interpreted by the Courts, in determining the full scope of the invention.

We claim:

1. A product for providing a finger nail polish coating to a fingernail comprising:

(a) a backing sheet of paper having an adhesive coating (b) a substantially uniformly thick, flat layer of partially cured, nail polish material, in the general shape of a fingernail, deposited as liquid on said backing sheet of paper, said layer, when removed from said backing sheet having at least some of said adhesive coating on its bottom surface for securement to a fingernail; said layer, when removed from said backing sheet, being non-liquid yet conformable, three-dimensionally to the curvature of a fingernail; and (c) said backing sheet of paper and said layer of nail polish material being stored, prior to use, in a substantially air-tight package to inhibit further curing until said package is desirably opened.

2. A product as claimed in claim 1, further comprising a ribbon means, attached to said backing sheet of paper for facilitating removal of said layer of said polish material from said backing sheet of paper.

3. A product as claimed in claim 1 wherein said layer of said nail polish material is about 0.04 mm thick.

4. A product as claimed in claim 1 wherein said layer of said nail polish material is formed from liquid, commercially available, nail enamel.

5. A product as claimed in claim 1, wherein said nail polish material has partially cured prior to storage in said package.

6. A product as claimed in claim 1, further comprising a visual design pattern directly printed on said layer of nail polish material.

7. A product as claimed in claim 6, wherein said visual design pattern is pad printed on said layer of nail polish material.

* * * * *